United States Patent [19]

Hiyoshi et al.

[11] 4,077,294

[45] Mar. 7, 1978

[54] ELECTRONIC MUSICAL INSTRUMENT HAVING TRANSIENT MUSICAL EFFECTS

[75] Inventors: Teruo Hiyoshi; Akira Nakada; Shigeru Yamada, all of Hamamatsu; Kiyoshi Ichikawa, Hamakita; Sigeki Isii, Hamamatsu, all of Japan

[73] Assignee: Nippon Gakki Seizo Kabushiki Kaisha, Hamamatsu, Japan

[21] Appl. No.: 730,426

[22] Filed: Oct. 7, 1976

[30] Foreign Application Priority Data

Oct. 7, 1975 Japan ..... 50-121055

[51] Int. Cl.[2] ..... G10H 1/06; G10H 5/02

[52] U.S. Cl. ..... 84/1.23; 84/1.24; 84/DIG. 5

[58] Field of Search ..... 84/1.01, 1.22–1.24, 84/DIG. 5

[56] References Cited

U.S. PATENT DOCUMENTS

| | | | |
|---|---|---|---|
| 3,740,450 | 6/1973 | Deutsch | 84/1.24 |
| 3,913,442 | 10/1975 | Deutsch | 84/1.23 X |
| 3,929,053 | 12/1975 | Deutsch | 84/1.24 |
| 3,978,755 | 9/1976 | Woron | 84/1.24 |
| 4,012,982 | 3/1977 | Southard | 84/1.01 |

*Primary Examiner*—Stanley J. Witkowski
*Attorney, Agent, or Firm*—Spensley, Horn & Lubitz

[57] ABSTRACT

An electronic musical instrument of a type wherein a plurality of systems are provided each system comprising memories storing respective harmonic component waveshapes which are read at the same reading rate and the read out harmonic waveshapes are suitably mixed to obtain a desired musical tone. Each system also comprises a circuit for controlling the envelope of the waveshapes read from the memories. In the first system, the envelope control is made in such a manner that the envelope will rise upon depression of a key, thereafter maintain a constant level as long as the key is kept depressed and decay upon release of the depressed key. In the second system, the envelope is controlled so that the envelope will rise in a short time and immediately decay thereafter. The respective harmonic waveshapes thus controlled in envelope in the respective systems are then suitably selected and mixed together. As an example of the envelope control in the second system is shown a structure for producing a so-called "chiff" effect by providing the fractional period during which the envelope rises and subsequently falls at the attack portion of the musical tone. Desired waveshape or waveshapes are selected from among the harmonic waveshapes controlled in the envelope in the second system for mixing with the harmonic waveshapes read from the first system. By this arrangement, amplitudes of the frequency components of the selected harmonic waveshapes are emphasized during the fractional period.

3 Claims, 6 Drawing Figures

DEPRESSED KEY DETECTION CIRCUIT
KEYBOARD
KEY ASSIGNER CIRCUIT
FREQUENCY INFORMATION MEMORY
FREQUENCY INFORMATION ACCUMALATOR
KC
F
qF
UE
LE
PE
ENVELOPE MEMORY
ENVELOPE COUNTER
CLOCK PULSE SELECTION
COUNT
AF
CLEAR
DCP
ACP
AS
DS
DF
CC
EV
TEV
PCP
DF'
HARMONIC COEFFICIENT MEMORY CIRCUIT
TONE COLOR SELECTION CIRCUIT
AUDIO SYSTEM
R1
R2
WM1
WM2
WM3
WM12
WM21
WM22
WM23
WM32

ELECTRONIC MUSICAL INSTRUMENT HAVING TRANSIENT MUSICAL EFFECTS

BACKGROUND OF THE INVENTION

This invention relates to an electronic musical instrument capable of achieving a transient musical tone effect such as "chiff" during a part of a period from the rise to the fall of a musical tone by emphasizing the amplitude (volume) of a selected one or ones of frequency components constituting the musical tone.

In a prior art electronic musical instrument wherein harmonic waveforms constituting a musical tone are stored in separate memories and the harmonics read out in parallel from the respective memories are mixed together to form a musical tone of a desired tone color, the tone pitch and the tone color of the musical tone are fixedly determined once the ratio of mixing of the respective harmonics is set and the set tone pitch and tone color never change from the start to the end of production of the musical tone. This tends to give an monotonous impression to the audience.

SUMMARY OF THE INVENTION

It is, therefore, an object of the present invention to provide an electronic musical instrument capable of producing a transient tone effect including "chiff" during a fractional part of a period from the start to the end of production of a musical tone by emphasizing a selected one of frequency components of the musical tone.

According to the present invention, a plurality of systems are provided in each of which harmonic waveforms constituting a musical tone are stored in separate memories and the harmonic waveforms are read from these memories and then suitably mixed together to form the musical tone. There are also provided in each of the systems an envelope generation circuit for controlling the amplitude envelope of the musical tone. In one of the systems, the envelope of the respective harmonics is controlled by an amplitude envelope of a continuous tone whereas the envelope of the respective harmonics in the other system is controlled by an amplitude envelope of a transient tone (e.g. an envelope of a percussive tone). A desired transient tone effect can be achieved by suitably mixing the respective harmonic components thus controlled in the amplitude envelope. With respect to the above described other system, a desired harmonic component or components are selected in mixing so as to realize a desired tone color or tone quality in the transient musical tone.

A preferred embodiment of the invention will now be described with reference to the accompanying drawings.

DESCRIPTION OF THE PREFERRED EMBODIMENTS

Figure 1:
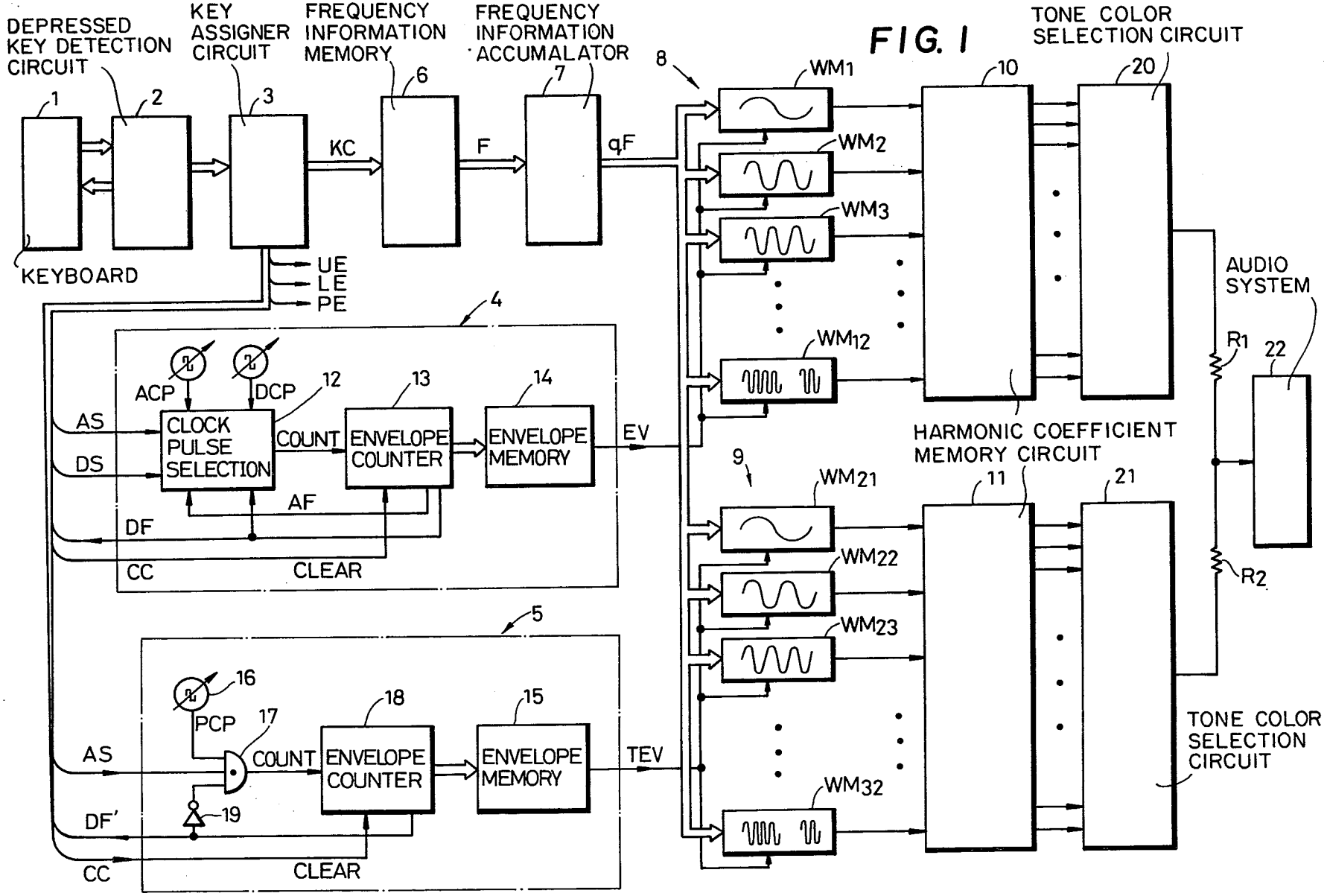
FIG. 1 is a block diagram of one embodiment of the electronic musical instrument of the present invention.

Referring first to FIG. 1, which shows one preferred embodiment of the electronic musical instrument of the present invention for achieving the transient tone effect, a depressed key detection or detector circuit 2 detects the on or off actuation of the respective key switches corresponding to the keys disposed at the keyboards 1 and thereby produces information for identifying the depressed key or keys. The key assigner circuit 3 receives the information for identifying the keys thus depressed from the depressed key detection circuit 2 and assigns the keys indicated by the information to available ones of the prepared channels for tone production is a number which is a maximum available number of musical tones to be simultaneously produced (e.g. 12 channels as in the present embodiment). The key assigner circuit 3 comprises storing positions defining the respective channels for storing key codes KC representative of the keys and successively outputs the key codes KC stored at the respective channels in a time-sharing manner. Accordingly, in case a plurality of keys are simultaneously depressed at the keyboards 1, the tones of the depressed keys are separately assigned to the respective channels in such a manner that the key codes KC indicative of the assigned tones of the depressed keys are stored at the storing positions defining the respective channels. The respective storing positions may preferably be constituted by respective stages of a circulating shift register. For example, assume that the key codes KC specifying the respective keys in the keyboards 1 consist of a suitable number of bits, e.g., 9 bits as in the present embodiment shown in the following Table I. Two bits of the 9 bits represent code $K_2$ and $K_1$ indicative of the kind or type of the keyboards, three bits of the 9 bits represent code $B_3$, $B_3$ and $B_1$ indicative of octave range, the rest four bits thereof represent codes $N_4$, $N_3$, $N_2$ and $N_1$ indicative of the musical notes within one octave and that the number of the entire channels is 12. There may be employed 12 stage 9 bit shift register.

Table I

| Kinds of Keys | | Key Codes KC | | | | | | | | |
|---|---|---|---|---|---|---|---|---|---|---|
| | | $K_2$ | $K_1$ | $B_3$ | $B_2$ | $B_1$ | $N_4$ | $N_3$ | $N_2$ | $N_1$ |
| Keyboards | Upper Keyboard | 0 | 1 | | | | | | | |
| | Lower Keyboard | 1 | 0 | | | | | | | |
| | Pedal Keyboard | 1 | 1 | | | | | | | |
| Octave Tone Range | 1st | | | 0 | 0 | 0 | | | | |
| | 2nd | | | 0 | 0 | 1 | | | | |
| | 3rd | | | 0 | 1 | 0 | | | | |
| | 4th | | | 0 | 1 | 1 | | | | |
| | 5th | | | 1 | 0 | 0 | | | | |
| | 6th | | | 1 | 0 | 1 | | | | |
| Musical Note | C# | | | | | | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |

In order for this embodiment to enable the electronic musical instrument to produce a plurality of musical tones simultaneously, the instrument is constructed as a dynamic logic circuit system wherein the logics, the counters, the memories, etc. are commonly used in a time-division manner so that the time relation of the clock pulses for controlling the operation of the instrument is very important. A chart (*a*) of FIG. 2 denotes a graph of main clock pulses $\phi_1$, which control the time-sharing operations of the respective channels and which, for example, has a pulse period of 1 $\mu$s. Since this embodiment of the electronic musical instrument of the present invention has 12 channels, the respective time slots with a pulse width of 1 $\mu$s partitioned by the main clock pulses $\phi_1$ sequentially correspond to first to twelfth channels, respectively. As illustrated at (*b*) of FIG. 2, the respective time slots will hereinafter be referred successively to as "first to twelfth channel times". The respective channel times will appear cyclically. Therefore, the key codes KC indicating the keys at the storing positions, defining the channels to which the tones of the keys to be produced are assigned by the key assigner 3, i.e., the key codes KC stored in the stages of the aforesaid shift register, are sequentially outputted in coincidence with the channel times thus assigned in time sharing fashion. It is for example assumed that the musical note C of the second octave range of the pedal keyboard is assigned to the first channel, the musical note G of the fifth octave range of the upper keyboard to the second channel, the musical note C of the fifth octave range of the upper keyboard to the third channel, the musical note E of the fourth octave range of the lower keyboard to the fourth channel, and no musical note is assigned to the fifth to twelfth channels. The key codes KC outputted in synchronization with the respective channel times in a time-sharing manner from the key assigner circuit 3 become as indicated at (*c*) in FIG. 2. The outputs from the fifth to twelfth channels are all "0".

The key assigner circuit 3 also delivers out an attack start signal or key-on signal AS representing that the musical tone should be produced at the channel to which the tone of the key is assigned upon depression of the key in synchronization with the respective channel times in a time-sharing manner. The key assigner circuit 3 further delivers out a decay start signal or key-off signal DS indicating that the musical tone should decay at the channel to which the tone of the key is assigned upon release of the key depressed in synchronization with the respective channel times in time sharing fashion. These signals AS and DS will be utilized in an envelope generation or generator circuit 4 for controlling the amplitude of the envelope of the musical tones (i.e. for controlling the tone production). The key assigner circuit 3 receives from the envelope generation circuit 4 a decay finish signal DF representing that the tone production at the corresponding channel is finished and thereupon produces a clear signal CC for clearing the various memories with respect to the corresponding channels based on the decay finish signal DF so as to completely eliminate the tone production assignment. The key assigner circuit 3 also delivers out the keyboard signals UE, LE and PE indicating which keyboard the depressed key belongs to in synchronization with the outputs of the key codes KC. The identification of the key code KC in relation to the kind of the keyboard can be made by the bits $K_2$ and $K_1$ of the code indicating the kind of the keyboard. Consequently, the respective keyboard signals UE, LE and PE can be developed by decoding the code $K_2$ and $K_1$ of the output key codes KC. In case, for example, of (*c*) in FIG. 2, the pedal keyboard signal PE becomes "1" at the first channel time as illustrated at (*f*) in FIG. 2, the upper keyboard signal UE becomes "1" at the second and third channel times as indicated at (*d*) in FIG. 2, and the lower keyboard signal LE becomes "1" at the fourth channel time as shown at (*e*) in FIG. 2. Assume, for example, that the keys assigned to the first and second channels remain depressed, the keys assigned to the third and fourth channels are released and the corresponding tones are decaying the tone production is finished at the fourth channel at the time slot $t_1$ with the decay finish signal DF being produced, and the clear signal CC is produced at the time slot $t_2$ after the delay of 12 channel times from the time slot $t_1$ as in the example shown at (*c*) in FIG. 2. The respective signals AS, DS, DF and CC are produced as illustrated at (*g*), (*h*), (*i*) and (*j*) in FIG. 2. As the key assigner circuit 3 delivers the clear signal CC at the time slot $t_2$, the attack start signal AS and the decay start signal DS are eliminated at the fourth channel. Simultaneously, the key codes KC and the lower keyboard signal LE shown at (*c*) and (*e*) in FIG. 2 respectively are also deleted at the fourth channel, but they are not erased from the drawings for convenience of explanation.

Figure 2:
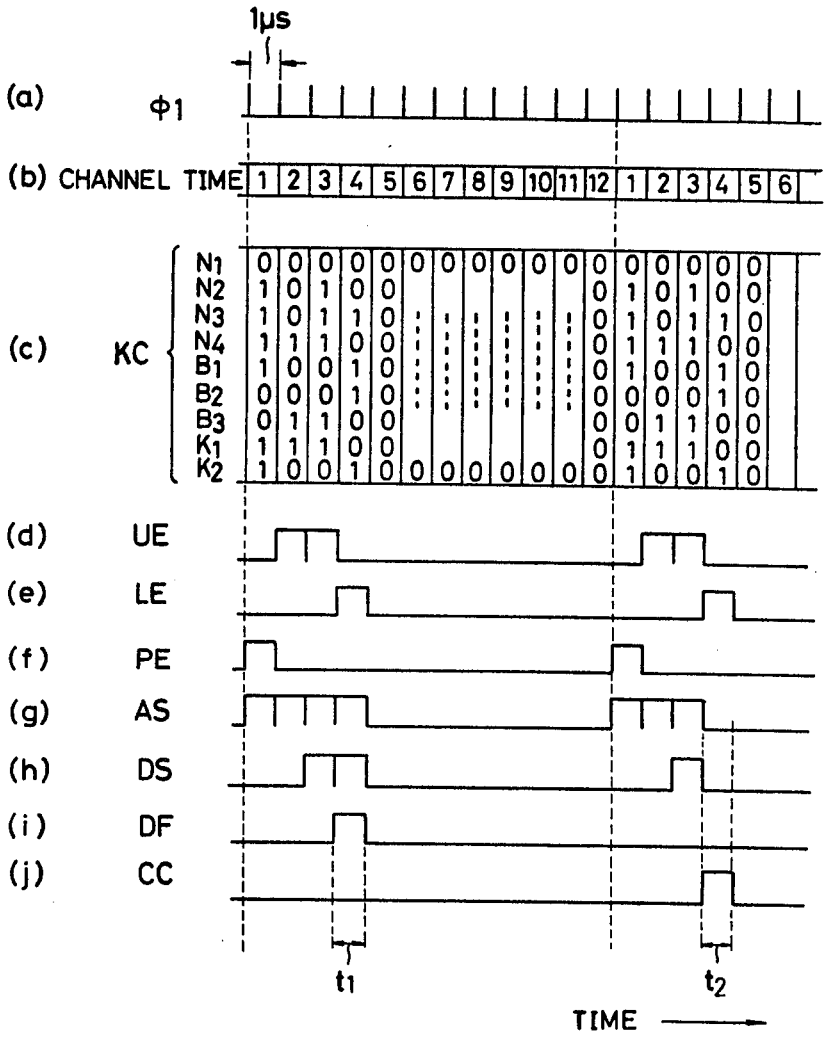
FIG. 2 is a graphical diagram for explaining the operation of the key assigner circuit in the embodiment of the invention.

As will be apparent from FIG. 2, a specific channel to which the various signals KC, AS, DS, CC, UE, LE and PE from the key assigner 3 are assigned can be known by the channel time.

The aforementioned key assigner circuit 3 and the depressed key detector circuit 2 will not further be described in detail. These circuits 2 and 3 may be the depressed key detection circuit and the key assigner, respectively of the types disclosed in U.S. Pat. No. 3,882,751 entitled "Electronic Musical Instrument employing waveshape memories" and assigned to the same assignee as in the present invention. These circuits 2 and 3 may also be constructed by the circuit arrangements other than the arrangements disclosed as described above within the spirit and scope of the present invention, but they will not be described in any greater detail.

It is to be noted that since the key codes KC delivered from the key assigner 3 represent the depressed keys, these key codes KC are utilized as address designation signals for reading out from a frequency information memory 6 a numerical information specific to the frequencies of the musical tones of the keys represented by to the key codes KC.

The frequency information memory 6 is constructed by, for example, a read-only memory (ROM) for storing the frequency information F (constants) corresponding to the key codes KC of the respective keys, which read-only memory serves the functions of delivering out the frequency information F stored at the address designated by the code upon receipt of a certain key code KC. The frequency information memory 6 is not limited only to this type of ROM but may also adopt other than this within the spirit and scope of the present invention. A frequency information accumulator 7 regularly makes cumulative addition of the frequency information F to develop successively increasing address signals for accessing memorized amplitude samples of the musical tone waveform at every predetermined constant time. Accordingly, the frequency respective information F are of digital numbers respectively proportional to the respective frequencies of the musical tones, such as, for example, binary numbers of 15 bits as disclosed in the specification of U.S. Pat. No. 3,882,751 entitled "Electronic musical instrument employing waveshape memories" assigned to the same assignee as in the present invention. This frequency information F for each frequency consists of a suitable number of bits, e.g. 15 as in the present embodiment, and represents numerals including fraction section if expressed in a decimal notation. The most significant bit of the 15 bits indicates an integer section and the rest of the bits, i.e., 14, represents a fraction section.

The value of the frequency information F may be unitarily determined at a certain constant sampling speed if the value of the frequency of the musical tone is specified. For example, assume that when the value $q$F cumulatively added with the information F by the frequency information accumulator 7 becomes 64 in a decimal notation, the sampling of the one musical tone waveform is completed (where $q = 1, 2, \ldots$) and also that this cumulative addition is achieved every 12 $\mu$s when the entire channel times are cyclically circulated once. The value of the frequency information F can be determined in accordance with the following equation:

$$F = 12 \times 64 \times f \times 10^{-6}$$

where $f$ signifies the frequencies of the musical tones. It will be understood that the frequency information F is stored in the frequency information memory 6 in accordance with the frequency $f$ to be obtained.

The frequency information accumulator 7 serves the functions of cumulatively adding the frequency information F of the respective channels at a predetermined constant sampling speed, e.g., at 12 $\mu$s per respective channel times in the present embodiment for obtaining the accumulated value $q$F so as to advance the phase of the musical tone waveform to be read out at every sampling time (12 $\mu$s). When the accumulated value $q$F reaches 64 (exceeds 63) in a decimal notation, the frequency information accumulator 7 overflows to return to zero to thus complete the reading of one waveform. Since 63 in a decimal notation can be represented by 6-bit binary number, the frequency information accumulator 7 is so constructed by a counter or accumulator of 20 bits in one word wherein the first to fourteenth bits represent the fraction section and fifteenth to twentieth bits represent the integer section as to keep the accumulated result until the accumulated value $q$F of the frequency information F whose fifteenth bit is the unit digit of the integer section becomes 64. It should be noted that the frequency information accumulator 7 is constructed by 12-stage/20-bit shift register together with a 20-bit adder commonly used for the respective channels in a time-sharing manner. The information 6 bits (integer section) from the most significant digit of the output $q$F of the frequency information accumulator 7 is applied to the waveshape memory groups 8 and 9 as the address input.

The waveshape memory groups 8, 9 respectively comprise a plurality of sinusoidal waveshape memories $WM_1$–$WM_{12}$ and $WM_{21}$–$WM_{32}$ corresponding to the harmonics of the respective orders. For example, the waveshape memories $WM_1$–$WM_{12}$, $WM_{21}$–$WM_{32}$ respectively store mutually different sinusoidal waveshapes corresponding to 12 harmonic frequencies, and harmonics of the first (fundamental), second, third, fourth, fifth, sixth, seventh, eight, tenth, twelfth, fourteenth and sixteenth orders are stored in the waveshape memories $WM_1$–$WM_{12}$, $WM_{21}$–$WM_{32}$, respectively, one harmonic in one memory. These waveshape memories $WM_1$–$WM_{12}$, $WM_{21}$–$WM_{32}$ are constructed in such a manner that waveshape amplitude values at sample points corresponding to the digital address signals are read out in analog quantity, and may adopt the memory constructed as disclosed in the specification of the U.S. Pat. No. 3,890,602 entitled "Waveform Producing Device". For example, the waveshape memories may be constructed so that amplitude value voltages at respective sample points of a waveshape are read out as desired by switching operation of electronic switching elements.

Since the same address signals ($q$F) are supplied from the frequency information accumulator 7 to the waveshape memory groups 8, 9, the sinusoidal waveshapes of the respective harmonic waves stored in the respective waveshape memories $WM_1$–$WM_{12}$, $WM_{21}$–$WM_{32}$ will be read out in parallel by the same address signals. If the address signals applied from the frequency information accumulator 7 to the memory groups 8, 9 are 6 bits, 64 different address signals can be produced and, accordingly, the number of sample points in each of the respective memories $WM_1$–$WM_{12}$, $WM_{21}$–$WM_{32}$ is 64. Since the contents of the respective memories $WM_1$–$WM_{12}$, $WM_{21}$–$WM_{32}$ are read out simultaneously by means of the same address signal, the number of waveshape stored in the memories $WM_1$–$WM_{12}$, $WM_{21}$–$WM_{32}$ is not necessarily one (1 cycle) but a number equal to the order of the harmonic. For example, the memories $WM_1$ and $WM_{21}$ store one cycle of sinusoidal waveshape at 64 sample points and the memories $WM_{12}$ and $WM_{32}$ store 16 cycles of sinusoidal waves at 64 sample points.

Accordingly, even though only one kind of output is produced from the information frequency accumulator 7, the waveshape memory groups 8, 9 produce 12 different kinds of sinusoidal wave signals, the respective frequencies being in harmonic relation to each other. That is, a plurality of harmonic frequencies are produced in parallel. Since these harmonic frequencies are of the same level, harmonic coefficient memory circuits 10, 11 are provided for adjusting the mixing levels of respective harmonic frequencies and thereby producing a desired tone color.

The circuit arrangement consisting of the waveshape memory group 8 and the harmonic coefficient memory circuit 10 is provided for forming the musical tones of normal sound. The envelope generation circuit 4 for the normal tones serves such function. The circuit arrangement containing the waveshape memory group 9 and the harmonic coefficient memory circuit 11 is provided for forming the transient tone. The envelope generation circuit 5 for the transient tone serves this function.

Figure 3:
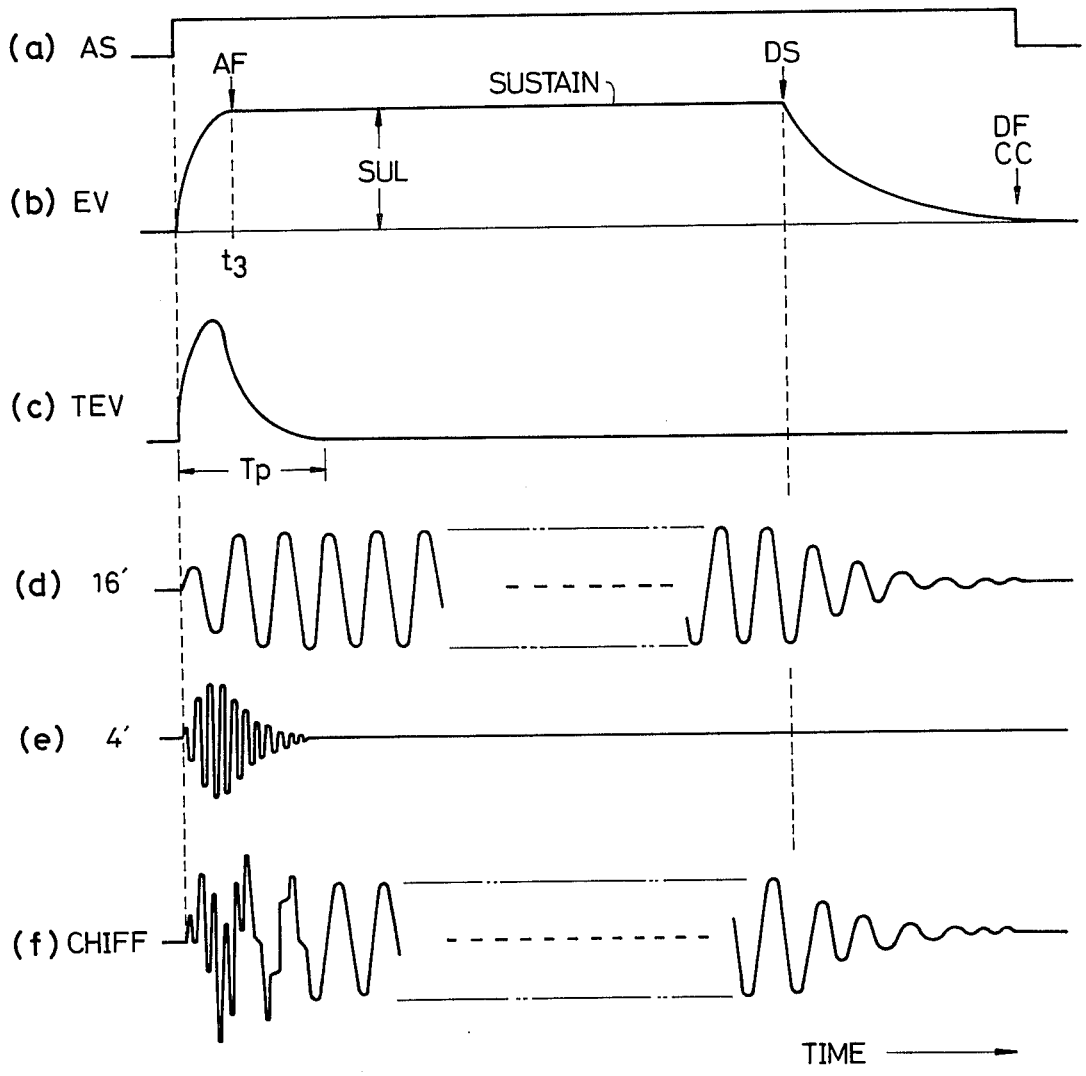
FIG. 3 is a chart showing one example of the output signals of the essential part in FIG. 1.

The envelope generation circuit 4 for the normal tones may, for example, employ the conventional circuit as disclosed in the specification of U.S. Pat. No. 3,882,751 entitled "Electronic musical instrument employing waveshape memories". For convenience of explanation, description will be made hereinbelow about one channel. FIG. 3 also shows only the one channel time for convenience of description. If a key is depressed in the keyboard 1, an attack start signal AS (see ($a$) in FIG. 3 is supplied from the key assigner circuit 3 at the channel time assigned to the key depressed. The clock selection circuit 12 selects the attack clock pulse ACP upon receipt of the attack start signal from the key assigner circuit 3 and drives the envelope counter 13. The envelope counter 13 thus driven sequentially counts the attack clock pulses ACP to cause the contents of the envelope memory 14 to be read out and thus to successively advance the address from 0, through 1, 2, 3 . . . The envelope memory 14 for the normal tone stores, for example, the envelope waveshape of the attack portion $A_1$ at the addresses 0–16 as shown at (*a*) in FIG. 4. The envelope memory 14 also stores the envelope waveshape of the decay portion $D_1$ at the addresses 17–63. Accordingly, as the count of the counter 13 has reached 16 (at the time point $t_3$ at (*b*) in FIG. 3), the envelope amplitude at the address 16 is read from the memory 14 resulting in completion of the attack portion $A_1$. When the counted value of the envelope counter 13 has reached 16, the attack finish signal AF is produced from the counter 13 to cause the clock selection circuit 12 to cease the selection of the attack clock pulses ACP. Consequently, counting is once stopped and the amplitude stored at the address 16 of the envelope memory 14 continues to be read out. Thus, a sustain state or level SUL is maintained (see (*b*) in FIG. 3).

Upon release of the depressed key, the decay start signal DS is produced from the key assigner circuit 3 and is then applied to the clock selection circuit 12 to cause the selection circuit 12 to select the decay clock pulses DCP, which is applied to the envelope counter 13. This causes the envelope counter 13 to resume the counting operation from 17 through 18, . . . to cause the envelope memory 14 to produce the envelope waveshape of the decay portion $D_1$. When the counted value of the envelope counter 13 has reached 63, the decay finish signal DF is produced from the envelope counter 13. This causes the clock pulse selection circuit 12 to cease the selection of the decay clock pulses DCP. Thus, the counting operation of the counter 13 is stopped. Consequently, the reading of the envelope waveshape from the memory 14 has been completed, and the envelope signal EV for forming the continuous tone for maintaining the amplitude of constant level SUL is produced during the depression of the key from the envelope memory 14. The duration of the attack portion $A_1$ is set by the speed of the attack clock pulse ACP, whereas the duration of the decay portion $D_1$ can be freely set by the speed of the decay clock pulses DCP.

Figure 4:
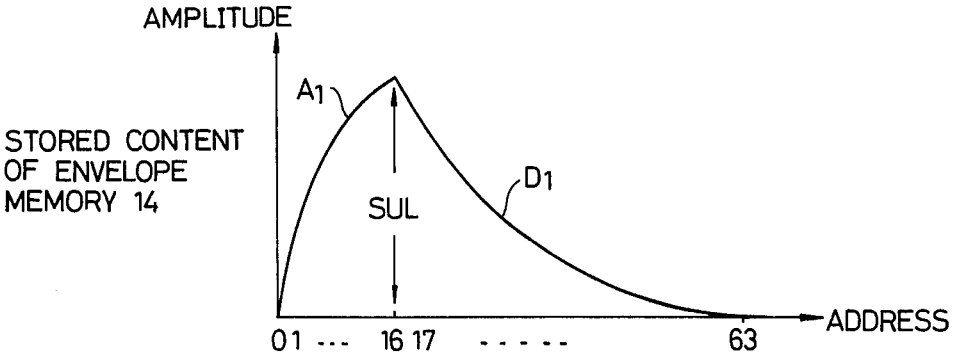
FIG. 4 is a chart of the stored contents of the envelope memories.
Figure 4:
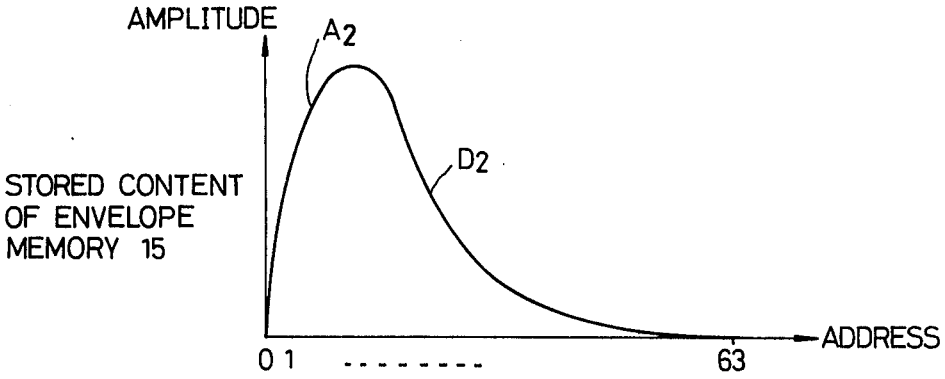

The envelope generation circuit 5 for the transient tone may, for example, comprise an envelope memory 15 for storing the percussive envelope shape shown at (*b*) in FIG. 4. This percussive envelope shape rises in its amplitude in the attack portion $A_2$ and subsequently falls in the amplitude in the decay portion $D_2$ immediately after the rise of the envelope amplitude, which slope is stored in the memory 15 at addresses 0 to 63. The duration of the transient tone (i.e. length of the percussive tone) will be set by adjusting the oscillating frequency of the clock pulse oscillator 16. The output of the clock pulses PCP of the clock pulse oscillator 16 is applied to the AND circuit 17 forming the clock selection circuit. When the attack start signal AS (see (*a*) of FIG. 3) is applied from the key assigner circuit 3 to the AND circuit 17, the clock pulse PCP produced by the clock pulse oscillator 16 is applied to the envelope counter 18. The envelope counter 18 will successively count the clock pulse PCP so as to increase the counted value from 0 through 1, 2, 3 . . . to cause the envelope memory 15 to deliver out its contents at the addresses 0, 1, 2, 3 . . . sequentially. As shown at (*c*) in FIG. 3, the envelope shape or percussive envelope TEV for the transient tone will be thereby read out from the envelope memory 15. When the counted value of the envelope counter 18 has reached final address 63, the readout finish signal DF′ is produced by the envelope counter 18 and is then applied through an inverter 19 to one of the input terminals of the AND circuit 17 to cause the AND circuit 17 to cease to pass the clock pulse PCP applied from the clock pulse oscillator 16 to the envelope counter 18.

The envelope signal EV for the normal tone (see FIG. 3(*b*)) is applied to the waveshape memories $WM_1$–$WM_{12}$ of one system and the envelope signal TEV for the percussive tone (see (*c*) of FIG. 3) is applied to the waveshape memories $WM_{21}$–$WM_{32}$ of the other system to allow the amplitudes of the respective harmonic waveshape signals (sinusoidal wave) read out from the respective memories $WM_1$–$WM_{12}$, $WM_{21}$–$WM_{32}$ to be changed timingly in response to the envelope shape of the signals. In the embodiment described above, the envelope memories 14, 15 are so constructed that the amplitude values of sampled envelope shape are read out in analog voltage in response to the digital address input in the same manner as the aforesaid waveshape memories $WM_1$–$WM_{32}$, and the analog envelope signals EV, TEV supplied to the respective waveshape memories $WM_1$–$WM_{12}$, $WM_{21}$–$WM_{32}$ become the power source voltage of the circuits forming the voltages constituting wave values of sampled sinusoidal waveshape in the respective memories $WM_1$–$WM_{12}$, $WM_{21}$–$WM_{32}$. Accordingly, the power source voltage in the circuit for generating the waveshape sample point amplitude voltage in each of the memories $WM_1$–$WM_{12}$ changes in accordance with change in the level of the envelope waveshape (i.e., change in the envelope) with a resultant change in the sample point amplitude voltage of the musical tone waveshape read from each of the memories $WM_1$–$WM_{12}$, $WM_{21}$–$WM_{32}$. If, for example, no envelope waveshape is read from the envelope memory 14 or 15, the power source voltage at the waveshape memories $WM_1$–$WM_{12}$, $WM_{21}$–$WM_{32}$ is zero, so that no musical tone waveshape is read out. In the above described manner, waveshape amplitude values are read from the memories $WM_1$–$WM_{12}$ at levels corresponding to the envelope waveshape.

In FIG. 3, the respective harmonic waveshapes of normal envelope amplitude are read out from the waveshape memory group 8 of one system to which the envelope signal EV for the normal tone (see (*b*) of FIG. 3) is applied, during the depression of the key, but the respective harmonic waveshapes are read out only during the period T*p* from the waveshape memory group 9 of the other system to which the percussive envelope signal TEV (see (*c*) of FIG. 3) is applied, and no harmonic waveshape amplitude will be read out except the period T*p*.

Figure 5:
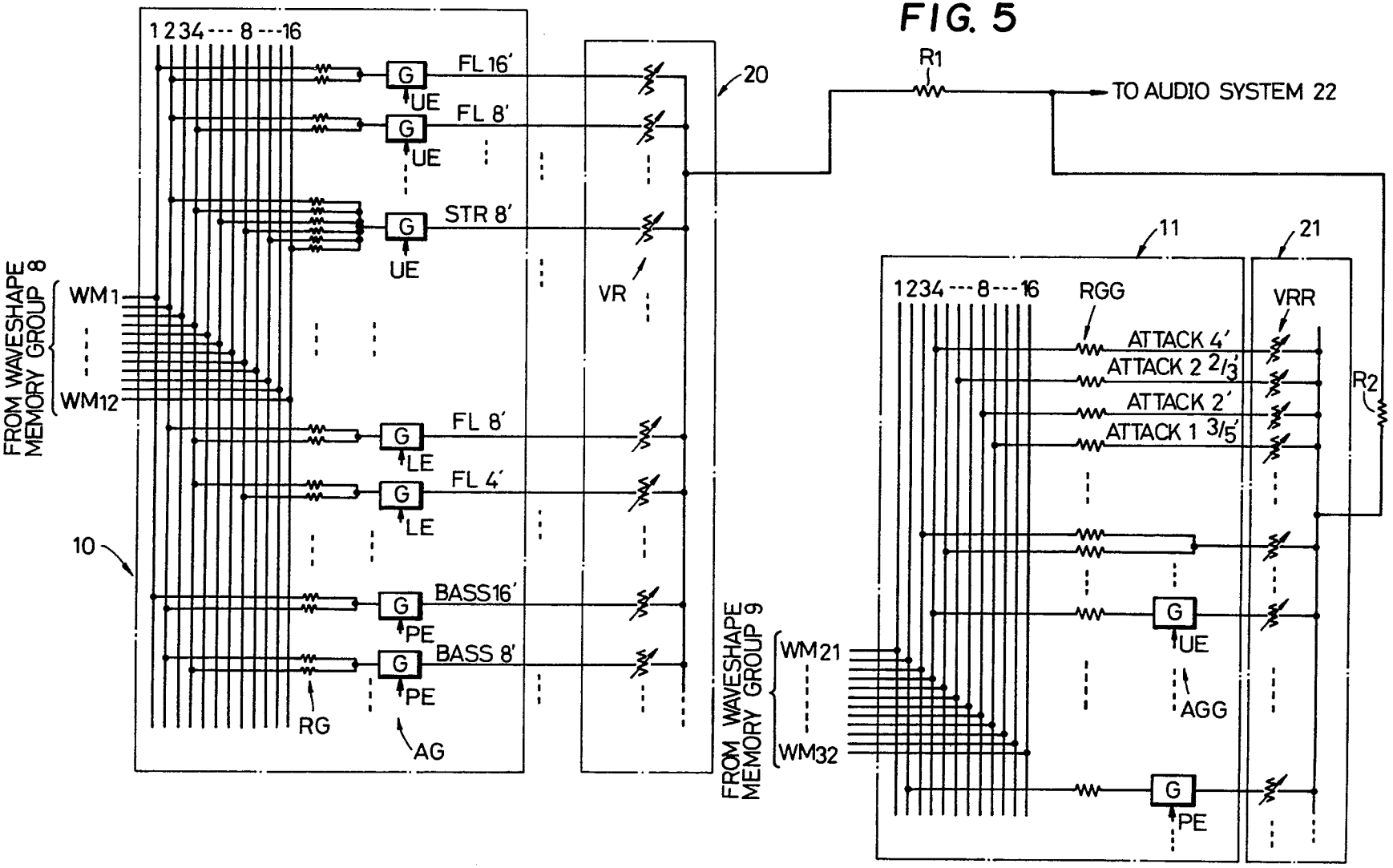
FIG. 5 is a schematic circuit diagram of one example of the harmonic coefficient memory circuit of the embodiment.

The harmonic coefficient memory circuits 10 and 11 serve the function of mixing the 12 kinds of harmonic frequency signals supplied from the waveshape memory groups 8 and 9 respectively at combinations and levels required for producing desired tone colors. The harmonic coefficient memory circuit 10 for the normal tone is a circuit for producing a signal of a desired tone color which does not change in time. As shown in FIG. 5, the twelve kinds of harmonic frequency signals supplied from each of the waveshape memories $WM_1$–$WM_{12}$ are resistance-mixed by a resistor group RG at combinations and levels required for producing a desired tone color. Resistor elements composing the resistor group RG have predetermined resistance values and relative amplitude levels among the harmonic frequencies provided by the waveshape memories ($WM_1$–$WM_{12}$) are determined by the resistance values. The harmonic wave signals of the orders required for producing a signal of a desired tone color are supplied to the resistor elements setting relative amplitude levels of the required harmonic components are mixed tone color by tone color, so that the mixed tone signals are thereafter applied to an analog gate circuit AG. Accordingly, a resistance mixing circuit is made up of the resistor group RG with respect to each of tones to be produced and the output of the resistance-mixing circuit is applied to the analog gate circuit AG. The combination of these resistance-mixing circuits and analog gate circuits are formed for each of the keyboards so that tone color control can be made keyboard by keyboard. For example, various tone colors (4' flute FL4', 8' flute FL8', 16' flute FL16', 8' strings STR8', etc.) can be generated with respect to each of the upper and lower keyboards. The upper keyboard signal UE, lower keyboard signal LE and pedal keyboard signal PE provided by the key assigner circuit 3 are respectively applied to the gate control input terminals of the gate circuits AG for the corresponding keyboards to enable these gate circuits AG.

The tone color selection circuit 20 selectively mixes the tone color by operation of the variable resistor element VR with respect to each of the tone colors available for production in each of the keyboards.

The harmonic coefficient memory circuit 11 for the transient tone functions to provide the pitch (register footage) of a transient specific frequency component (harmonic component) used as the transient tone to add the transient prominence of the desired tone quality. As shown in FIG. 5, the twelve kinds of harmonic frequency signals supplied from the respective waveshape memories $WM_1$–$WM_{12}$ and provided with the envelope of the transient tone (percussive tone) are produced through a resistor group REG with an amplitude as required to the transient tone selection circuit 21. This embodiment illustrated in FIG. 5 performs the function of producing "chiff" in the attack portion of the envelope. For example, it is assumed that the tone of the fourth harmonic is nominated as attack 4' the sixth harmonic as attack 2 2'/3, the eight harmonic as attack 2'. A plurality of specific harmonic components (such as, for example, the harmonic waves of third order and fifth order) may also be resistance-mixed by a resistor group at suitable levels for producing a desired tone color. In addition, an analog gate circuits AGG may also be formed in the same manner as the harmonic coefficient memory circuit 10, so that the frequency components of the transient tones and their combination and ratio of their amplitudes can be selected keyboard by keyboard.

The transient tone selection circuit 21 serves the function of selecting as required various transient tone colors producible by the harmonic coefficient memory circuit 11 by means of the control operation of the variable resistor element VRR. The outputs of the selection circuits 20, 21 of these two systems are mixed by each tone color through the resistance elements $R_1$, $R_2$ and supplied to the audio system 22 for producing a desired tone color. For example, assume that of foot tone (such as, for example, flute FL16') is selected in the tone color selection circuit 20 for the normal tone. The musical tone signal of continuous tone indicated at (*d*) in FIG. 3 will be produced from the selection circuit 20 in the example shown in FIG. 3. If the transient tone of attack 4' is selected in the transient tone selection circuit 21, the transient tone signal as shown at (*e*) in FIG. 3 will be produced from the selection circuit 21. Both signals are mixed through the resistance elements $R_1$, $R_2$ for producing "chiff" as illustrated at (*f*) in FIG. 3.

The key assigner circuit 3 receives the decay finish signal DF from the envelope counter 13 and the read finish signal DF' from the envelope counter 18, and produces a clear signal CC when the AND condition of both the signals DF and DF' is satisfied, i.e., when the production of one tone is completely finished, thereby clearing the counters 13 and 18. The envelope counters 13, 18 each comprise an adder and a shift register of stages and bits corresponding to the number of channels, in the same manner as the aforementioned frequency information accumulator 7 thereby causing them to successively perform counting with respect to each of the channels in a time-sharing manner.

The foregoing description of the above embodiment has been made with respect to the case where the musical tone such as "chiff" emphasized by the percussive tone at the attack portion is produced. It will be understood, however, that with respect to other various transient tone effects a similar operation is performed. For example, although the attack start signal AS is applied to the AND circuit 17 of the envelope generation circuit 5 for the normal tone in FIG. 1, the transient tone effect may also be carried out at the sustain portion of the envelope of the tone amplitude by applying the attack finish signal AF from the envelope counter 13 to the circuit 17. Furthermore, if the decay start signal DS is applied to the AND circuit 17 so as to start the counter 18 thereby, the transient tone effect may also be achieved during the decay time of the tone after release of the depressed key. It should be appreciated that the envelope shape stored in the envelope memory 15 for the transient tone may not only be employed with the percussive envelope as shown at (*b*) in FIG. 4, but also be with envelope of any shape other than the one described above and can be stored in any shape of envelope in response to the tone quality of the transient tone to be performed. The length of time for providing the transient tone effect may be freely set by changing the speed of the clock pulses PCP produced by the clock pulse oscillator 16 as previously described.

The system for forming the transient tone consisting of the waveshape memory group 9, harmonic coefficient memory circuit 11 and selection circuit 21 may be provided in a plurality. In this case, a plurality of envelope generation circuits constructed in the same manner as the envelope generation circuit 5 may be provided in the respective systems. The respective envelope generation circuits and harmonic coefficient memory circuits may be so constituted as to accomplish different transient tones in the respective systems and desired transient tones can be selected in the selection circuit.

In case where read-only memories and the like are used for the waveshape memories $WM_1$–$WM_{12}$, $WM_{21}$–$WM_{32}$ so as to read out the digital values of sample sinusoidal waveshape amplitudes, a weighting circuit (not shown) may preferably be separately provided in each of the harmonic waves for imparting the amplitude envelope of the respective harmonic wave components in response to the outputs EV, TEV of the respective envelope memories 14, 15. With regard to the weighting circuit, when the input is in a digital form, a digital multiplier may be employed and the digital output from the multiplier may be converted thereafter to analog among and the converted output is applied to the harmonic coefficient memory circuits 10, 11. If the input is converted to an analog form, the weighting circuit may be composed be a voltage-controlled amplifier and the like.

What is claimed is:

1. An electronic musical instrument comprising:

address signal generating means which generates an address signal that corresponds to a frequency of a tone to be produced;

a plurality of waveshape memory systems, each system including memories storing respective harmonic waveshapes, said memories all being connected to said address signal generating means so as to be read out in parallel by said address signal;

a first circuit for producing a first envelope signal which rises upon depression of a key, sustains at a certain level while the key is being depressed and decays upon release of the key, and controlling the amplitude of the respective harmonic waveshapes read from one of said plurality of waveshape memory systems by said first envelope signal, said first envelope signal thereby establishing a tone production period that begins upon depression of said key and terminates at the end of said decay after release of said key;

a second circuit for producing a second envelope signal which rises and thereafter falls during a fractional portion of time of said tone production period, and controlling the amplitude of the respective harmonic waveshapes read from the rest of said plurality of waveshape memory systems by said second envelope signal; and a selection and mixing circuit for selectively mixing the harmonic waveshapes read from the respective waveshape memory systems;

thereby producing a musical tone wherein tone color and volume changes during said fractional portion of time relative to the rest of the tone production period.

2. An electronic musical instrument as defined in claim 1 wherein said first envelope signal includes an attack portion and wherein said fractional portion of time occurs in said attack portion of said first envelope signal.

3. An electronic musical instrument as defined in claim 1 wherein said selection and mixing circuit selects a specific subset of said harmonic waveshapes read from said rest of the waveshape memory systems for changing the tone color of the musical tone during said fractional portion of time.

* * * * *